United States Patent [19]

Sato et al.

[11] 4,152,163

[45] May 1, 1979

[54] SILVER HALIDE PHOTOGRAPHIC EMULSION CONTAINING CYANINE AND HEMICYANINE SENSITIZING DYES

[75] Inventors: Akira Sato; Tadashi Ikeda; Takeo Sakai; Haruo Takei; Jun Hayashi, all of Minami-ashigara, Japan

[73] Assignee: Fuji Photo Film Co., Ltd., Minami-ashigara, Japan

[21] Appl. No.: 777,229

[22] Filed: Mar. 14, 1977

[30] Foreign Application Priority Data

Mar. 15, 1976 [JP] Japan ..... 51-27941

[51] Int. Cl.[2] ..... G03C 1/14; G03C 1/19

[52] U.S. Cl. ..... 96/124; 96/126

[58] Field of Search ..... 96/124, 126, 139

[56] References Cited

U.S. PATENT DOCUMENTS

| | | | |
|---|---|---|---|
| 2,694,638 | 11/1954 | Carroll | 96/139 |
| 3,338,714 | 8/1967 | Ficken et al. | 96/124 |
| 3,615,609 | 10/1971 | Fry et al. | 96/124 |
| 3,615,635 | 10/1971 | Shiba et al. | 96/140 |
| 3,679,428 | 7/1972 | Shiba et al. | 96/124 |
| 3,977,882 | 8/1976 | Shiba et al. | 96/124 |
| 4,039,335 | 8/1977 | Hinata et al. | 96/124 |

*Primary Examiner*—Richard L. Schilling

*Attorney, Agent, or Firm*—Sughrue, Rothwell, Mion, Zinn and Macpeak

[57] ABSTRACT

A spectrally sensitized silver halide photographic emulsion comprising a silver halide emulsion containing a combination of at least one sensitizing dye represented by the following general formula (I):

(I)

at least one sensitizing dye represented by the following general formula (II):

(II)

and at least one organic heterocyclic compound represented by the following general formula (III) or (IV):

(III)

(IV)

wherein $Z^1$ and $Z^2$, which may be the same or different, each represents a group of atoms necessary for forming a thiazole nucleus or a selenazole nucleus; $Z^3$ has the same meaning as $Z^1$ and $Z^2$; $Z^4$ represents a group of atoms necessary for forming an imidazole nucleus or an oxazole nucleus; $Z^5$ represents a group of atoms necessary for forming an imidazole nucleus; $R^1$, $R^2$, $R^4$, $R^5$ and $R^7$, which may be the same or different, each represents an alkyl group, with at least one of $R^1$, $R^2$, $R^4$ and $R^5$ being an alkyl group substituted with a carboxy group, a hydroxy group or a sulfo group; $R^3$ and $R^6$, which may be the same or different, each represents a lower alkyl group, an aryl group or a hydrogen atom; $R^8$ represents a hydrogen atom or an alkylene group necessary for forming a ring through a combination with $R^7$; $R^9$ represents an aryl group (including a monocyclic aryl group and a bicyclic aryl group); $X_1^-$, $X_2^-$ and $X_3^-$ each represents an acid anion; m, n and p each represents 1 or 2, but when m, n or p is 1, the dye forms an intramolecular salt.

The photographic emulsion exhibits a high sensitivity with a reduced fog and stain, and a good stability with the lapse of time during and after production, and further an improved latent image stability with the lapse of time of from image-wise exposure to development.

12 Claims, 2 Drawing Figures

SILVER HALIDE PHOTOGRAPHIC EMULSION CONTAINING CYANINE AND HEMICYANINE SENSITIZING DYES

BACKGROUND OF THE INVENTION

1. Field of the Invention

The present invention relates to silver halide photographic emulsions which are spectrally sensitized, particularly, those which are suitable for producing a red-sensitive emulsion layer of a multilayer color light-sensitive material.

2. Description of the Prior Art

Spectral sensitization is an extremely important technique which has been used to not only impart spectral sensitivity to a silver halide photographic emulsion ranging from the sensitization region intrinsic to the silver halide to the longer wavelength region corresponding to green light and red light, but also to increase the total sensitivity thereof (to white light). Particularly, since multilayer color photosensitive materials require respective photographic emulsion layers sensitive to not only blue light but also to green light and to red light, spectral sensitization is indispensable for the production of a green-sensitive emulsion layer and a red-sensitive emulsion layer.

Furthermore, a more suitable color reproducibility for color light-sensitive materials is strongly required. Therefore, the characteristics of spectral sensitivity of a green-sensitive layer and a red-sensitive layer are, from the standpoint of obtaining excellent color reproducibility, significant. In particular, it is important to select the red-sensitive layer because the wavelength of the maximum sensitivity of the red-sensitive layer delicately affects the reproduction of skin color, which is a significant factor in color photographs, and also influences variations of color balance caused by changes in the light source used for exposure, as disclosed in U.S. Pat. No. 3,672,898, corresponding to Japanese Patent Publication No. 6207/74. For example, Japanese Patent Publication No. 6207/74 discloses that the selection of about 605 nm (±5 nm) as the wavelength of the maximum sensitivity of the red-sensitive layer in a multilayer color light-sensitive material is desirable to maintain color balance under the best condition when three kinds of sources of light for exposure are used, i.e., day light, light from a tungsten lamp and light from a fluorescent lamp. However, it is not preferred, for the purpose of producing highly sensitive color light-sensitive materials for camera exposure, to choose the above-described wavelength as that of the maximum sensitivity of the red-sensitive emulsion layer because such an emulsion does not have a high sensitivity, though the smallest variations in color balance are achieved therewith in using the light sources described above, and, therefore, it is necessary for the grain size of silver halide in the photographic emulsion to be large to increase the sensitivity. Unfortunately, an increase in grain size results in a sacrifice of graininess and sharpness.

It was found that if the red-sensitive layer had a maximum sensitivity within the wavelength region ranging from 625 nm to 645 nm and in addition, a spectral sensitivity in the wavelength region ranging from 580 nm to 600 nm corresponding to at least 40% of the maximum spectral sensitivity was most advantageous to obtain highly sensitive color light-sensitive materials which possess a satisfactory high color reproducibility without deteriorating both graininess and sharpness.

When spectral sensitization is carried out with a combination of two or more sensitizing dyes or of a sensitizing dye and an organic heterocyclic compound in order to render the photographic emulsion spectrally sensitive to the above-described wavelength region, sometimes a decrease in spectral sensitivity in a specific spectral sensitized wavelength region, an increase in fog, a deterioration of stability with the lapse of time such as decreasing of sensitivity and increasing of fog during or after production of the light-sensitive materials and a deterioration of the stability of the latent image with the lapse of time of from photographing to development occur. It can thus be seen that many combinations of sensitizing dyes are unsuitable for producing a spectrally sensitized photographic emulsion having desired photographic properties. One of the most important problems in the art of producing light-sensitive materials is to spectrally sensitize by selecting and then combining sensitizing dyes which do not adversely affect the photographic properties thereof.

Moreover, a requirement for a sensitizing dye is for the spectral sensitization action inherent to the sensitizing dye not to be inhibited by couplers which may be co-present therewith, since modern multilayer color light-sensitive materials contain color image-forming couplers in the respective photographic emulsion layers. Furthermore, coloration due to residual dye must not appear after photographic processings, since the hue of the color photograph obtained is remarkably impaired by such coloration.

SUMMARY OF THE INVENTION

Therefore, a first object of the present invention is to provide a silver halide photographic emulsion having an increased sensitivity, but with reduced fog and stain, and further, an excellent stability with the lapse of time during and after production of the light-sensitive material and, moreover, an improved stability of the latent image with the lapse of time from image exposure to development.

A second object of the present invention is to provide a silver halide photographic emulsion suitable for use in producing a red-sensitive layer of a highly sensitive color photographic light-sensitive material which is scarcely affected by the differences in the three kinds of light sources generally used for exposure, i.e., sunlight, light from a tungsten lamp and light from a fluorescent lamp.

A third object of the present invention is to provide a silver halide photographic emulsion spectrally sensitized such that the wavelength of the maximum sensitivity ranges from about 625 to about 645 nm and in addition, the spectral sensitivity in the wavelength region ranging from about 580 to about 600 nm corresponds to at least about 40% of the maximum spectral sensitivity so as to obtain a highly sensitive color photographic light-sensitive emulsion providing an excellent color reproduction upon exposure to the above-described three kinds of light sources.

The above objects of this invention have been accomplished by a silver halide photographic emulsion containing a combination of at least one sensitizing dye represented by the following general formula (I):

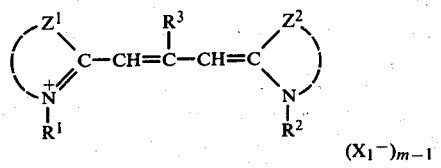

(I)

at least one sensitizing dye represented by the following general formula (II):

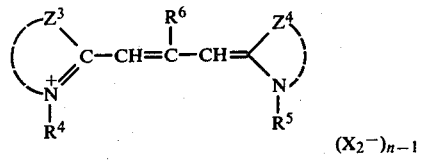

(II)

and at least one organic heterocyclic compound represented by the following general formula (III) or (IV):

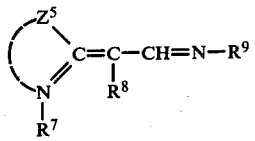

(III)

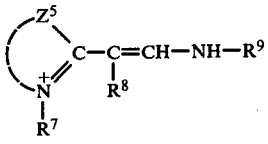

(IV)

wherein $Z^1$ and $Z^2$, which may be the same or different, each represents a group of atoms necessary for forming a thiazole nucleus or a selenazole nucleus; $Z^3$ has the same meaning as $Z^1$ and $Z^2$; $Z^4$ represents a group of atoms necessary for forming an imidazole nucleus or an oxazole nucleus; $Z^5$ represents a group of atoms necessary for forming an imidazole nucleus; $R^1$, $R^2$, $R^4$, $R^5$ and $R^7$, which may be the same or different, each represents an alkyl group (in which the carbon atom chain may be interrupted by a hetero atom such as S, N and/or O); $R^3$ and $R^6$, which may be the same or different, each represents a lower alkyl group, an aryl group or a hydrogen atom; $R^8$ represents a hydrogen atom or an alkylene group necessary for forming a ring by combination with $R^7$; $R^9$ represents an aryl group (including a monocyclic aryl group and a bicyclic aryl group); $X_1^-$, $X_2^-$ and $X_3^-$ each represents an acid anion; m, n and p each represents 1 or 2, but when m, n or p is 1, the dye forms an intramolecular salt; and at least one of $R^1$, $R^2$, $R^4$ and $R^5$ is an alkyl group substituted with a sulfo group, a hydroxy group or a carboxy group.

DETAILED DESCRIPTION OF THE INVENTION

Figure 1:
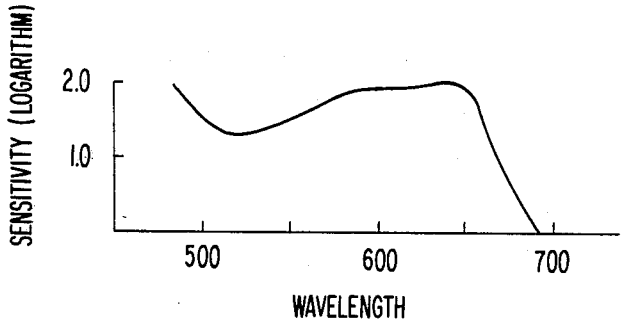
FIGS. 1 and 2 each shows spectral sensitivity curves obtained in Test Nos. 8-2 and 11-1 as illustrated in the Table 2 of Example 2.
Figure 2:
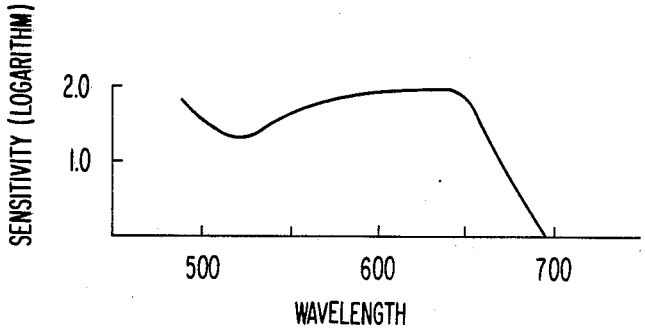

Specific examples of the thiazole nucleus (including substituted or unsubstituted benzothiazole and naphthothiazole nuclei and the like) or the selenazole nucleus (including substituted and unsubstituted benzoselenazole and naphthoselenazole nuclei and the like) each formed by $Z^1$, $Z^2$ or $Z^3$ include, e.g., a thiazole nucleus such as thiazole, 4-methylthiazole, 4-phenylthiazole, 5-methylthiazole, 5-phenylthiazole, 4,5-dimethylthiazole, benzothiazole, 4-chlorobenzothiazole, 5-chlorobenzothiazole, 6-chlorobenzothiazole, 7-chlorobenzothiazole, 5-methylbenzothiazole, 6-methylbenzothiazole, 5-bromobenzothiazole, 5-carboxybenzothiazole, 5-ethoxycarbonylbenzothiazole, 5-hydroxybenzothiazole, 5-methoxycarbonylbenzothiazole, 5-butylbenzothiazole, 5-pivaloylaminobenzothiazole, 6-benzoylaminobenzothiazole, 5-acetylbenzothiazole, 6-acetylaminobenzothiazole, 5-phenylbenzothiazole, 5-methoxybenzothiazole, 6-methoxybenzothiazole, 5-iodobenzothiazole, 5-methoxy-6-methylbenzothiazole, tetrahydrobenzothiazole, 5,6-dimethoxybenzothiazole, 5,6-dioxymethylenebenzothiazole, 6-ethoxy-5-methylbenzothiazole, 5-phenoxybenzothiazole, 5-phenethylbenzothiazole, 5-cyanobenzothiazole, 5-acetylbenzothiazole, naphtho[1,2-d]thiazole, naphtho[2,1-d]thiazole, naphtho[2,3-d]thiazole, 5-methoxynaphtho[1,2-d]thiazole, 5-ethoxynaphtho[1,2-d]thiazole, 8-methoxynaphtho[2,1-d]thiazole, 7-methoxynaphtho[2,1-d]thiazole, 5-methoxythionaphtheno[6,7-d]thiazole, 8,9-dihydronaphtho[1,2-d]thiazole and 4,5-dihydronaphtho[2,1-d]thiazole; a selenazole nucleus such as 4-methylselenazole, 4-phenylselenazole, benzoselenazole, 5-chlorobenzoselenazole, 5-methoxybenzoselenazole, 5-methylbenzoselenazole, 5,6-dimethylbenzoselenazole, tetrahydrobenzoselenazole, naphtho[1,2-d]selenazole and naphtho[2,1-d]selenazole.

Specific examples of the imidazole nucleus (including substituted and unsubstituted benzimidazole and naphthimidazole nuclei and the like) each formed by $Z^4$ or $Z^5$ include imidazoles such as imidazole, 1-alkylimidazole, 1-alkyl-4-phenylimidazole and 1-alkyl-4,5-dimethylimidazole; benzimidazoles such as benzimidazole, 1-alkylbenzimidazole, 1-alkyl-5,6-dichlorobenzimidazole, 1-tolyl-5-chlorobenzimidazole, 1-alkyl-5-bromobenzimidazole, 1-alkyl-5-chlorobenzimidazole, 1-alkyl-5-fluorobenzimidazole, 1-alkyl-5-thiocyanatobenzimidazole, 1-alkyl-5-acetyl-6-chlorobenzimidazole, 1-phenyl-5,6-dichlorobenzimidazole, 1-alkyl-5-trifluoromethylbenzimidazole, 1-alkyl-5-methylsulfonylbenzimidazole, 1-alkyl-5-methoxycarbonylbenzimidazole, 1-alkyl-5-ethoxycarbonylbenzimidazole, 1-alkyl-5-carboxybenzimidazole, 1-alkyl-5-benzoylbenzimidazole and 1-alkyl-5-acetylbenzimidazole; and naphthoimidazoles such as 1-alkylnaphtho[1,2-d]imidazole, 1-alkylnaphtho[2,1-d]imidazole and 1-alkyl-naphtho[2,3-d]imidazole; in which the 1-alkyl moiety in the above-described nuclei has the same meanings as that of the alkyl group of $R^1$, $R^2$, $R^4$, $R^5$ or $R^7$.

Specific examples of the oxazole nucleus formed by $Z^4$ include oxazoles such as 4-methyloxazole, 5-methyloxazole, 4-phenyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole, 5-ethoxybenzoxazole, 5-phenethylbenzoxazole, 5-carboxybenzoxazole, 5-hydroxybenzoxazole, 5-ethoxycarbonylbenzoxazole, 5-bromobenzoxazole, 5-phenoxybenzoxazole, 5-acetylbenzoxazole, 5-methyl-6-chlorobenzoxazole, naphtho[1,2-d]oxazole, naphtho[2,1-d]oxazole and naphtho[2,3-d]oxazole.

The alkyl group represented by $R^1$, $R^2$, $R^4$, $R^5$ or $R^7$ may be interrupted by a hetero atom such as O, N and/or S, i.e., a carbon atom in the carbon atom chain thereof replaced thereby, may be straight or branched chained or cyclic and may have an unsaturated bond in the alkyl chain thereof. The alkyl chain group can be an alkyl group preferably having 10 or less carbon atoms which may be substituted with one or more substituents such as a sulfo group, an aryl group, a carboxy group, an amino group (primary, secondary, tertiary), an alkoxy group, an aryloxy group, a hydroxy group, an alkoxycarbonyl group, an acyloxy group, a halogen atom, an acyl group, an aminocarbonyl group or a cyano group.

Specific examples of suitable alkyl groups for $R^1$, $R^2$, $R^4$, $R^5$ or $R^7$ include a methyl group, an ethyl group, a sulfoethyl group, a sulfopropyl group, a sulfobutyl group, a benzyl group, a phenethyl group, a carboxyethyl group, a carboxymethyl group, a dimethylaminopropyl group, a methoxyethyl group, a phenoxypropyl group, a methylsulfonylethyl group, a p-t-butylphenoxyethyl group, a cyclohexyl group, an octyl group, a decyl group, a carbamoylethyl group, a sulfophenethyl group, a sulfobenzyl group, a 2-hydroxy-3-sulfopropyl group, an ethoxycarbonylethyl group, a 2,3-disulfopropoxypropyl group, a sulfopropoxyethoxyethyl group, a trifluoroethyl group, a carboxybenzyl group, a cyanopropyl group, a p-carboxyphenethyl group, an ethoxycarbonylmethyl group, a pivaloylpropyl group, a propionylethyl group, an anisyl group, an acetoxyethyl group, a benzoyloxypropyl group, a chloroethyl group, a morpholinoethyl group, an acetylaminoethyl group, an N-ethylaminocarbonylpropyl group, an allyl group, a 2-butenyl group, a 2-propynyl group, a cyanoethyl group, etc.

The lower alkyl group represented by $R^3$ or $R^6$ is, preferably an alkyl group containing 4 or less carbon atoms in the alkyl moiety, which may be substituted with a phenyl group, a tolyl group or the like, and wherein the carbon chain may be interrupted by an oxygen atom. Specific examples of lower alkyl groups represented by $R^3$ and $R^6$ include a methyl group, an ethyl group, a propyl group, a butyl group, a benzyl group, a phenethyl group, a methoxyethyl group, and a tolylethyl group.

The aryl group represented by $R^3$, $R^6$ and $R^9$ is an aryl group preferably having either a monocyclic or a bicyclic ring, with specific examples of which group including a phenyl group, a naphthyl group, a tolyl group, an anisyl group, a carboxyphenyl group, a methoxycarbonylphenyl group, a chlorophenyl group, a xylyl group, a thienyl group and a furyl group.

Where $R^8$ forms a ring through combination with $R^7$, it is particularly preferred for a 5-, 6- or 7-membered ring to be formed.

The acid anion represented by $X_1^-$, $X_2^-$ and $X_3^-$ is an acid anion generally used in salts of conventional cyanine dyes such as an iodide ion, a bromide ion, a chloride ion, a p-toluenesulfonate ion, a benzenesulfonate ion, a sulfate ion, a perchlorate ion and a thiocyanate ion.

Particularly useful sensitizing dyes represented by the above-described general formula (I) are compounds wherein $R^3$ is a phenyl group or an unsubstituted alkyl group having 4 or less carbon atoms and in addition at least one of $R^1$ and $R^2$ is an alkyl group substituted with a sulfo group. It is particularly useful for the silver halide photographic emulsion to contain at least two sensitizing dyes represented by the general formula (I).

Of the compounds represented by the above-described general formulas (II), (III) and (IV), particularly effective compounds are compounds each represented by the following general formulas (II-A), (II-B), (III-A) and (IV-A).

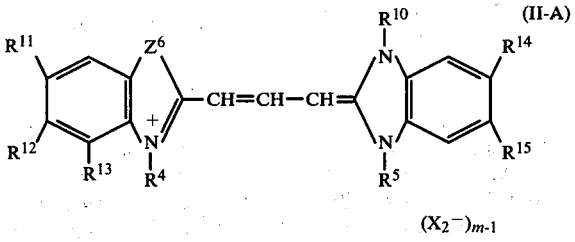

wherein $Z^6$ represents a sulfur atom or a selenium atom; $R^4$, $R^5$ and $R^{10}$, which may be the same or different, have the same meanings as $R^4$ and $R^5$ of the above-described general formula (II); $R^{11}$ and $R^{12}$, which may be the same or different, represent a halogen atom (e.g., a chlorine atom, a bromine atom, an iodine atom), an alkyl group containing 4 or less carbon atoms in the alkyl moiety (e.g., a methyl group, an ethyl group, a propyl group, a butyl group, a phenethyl group, etc.), an alkoxycarbonyl group having 5 or less carbon atoms (e.g., a methoxycarbonyl group, an ethoxycarbonyl group, a butoxycarbonyl group, etc.), a carboxy group, a hydroxy group, an acylamino group (e.g., an acetylamino group, a benzoylamino group, a pivaloylamino group, etc.), a phenyl group, an alkoxy group having 4 or less carbon atoms (e.g., a methoxy group, an ethoxy group, a propoxy group, a butoxy group, etc.), or a hydrogen atom; $R^{11}$ may form a benzene ring or a dioxymethylene group through combination with $R^{12}$; $R^{13}$ represents a hydrogen atom or forms a benzene ring through a combination with $R^{12}$; $R^{14}$ and $R^{15}$, which may be the same or different, each represents a hydrogen atom or an electron attracting group (e.g., a fluorine atom, a chlorine atom, a bromine atom, a cyano group, a nitro group, a thiocyanate group, an acyl group such as an acetyl group, a propionyl group, a benzoyl group and a methylsulfonyl group, a trifluoromethyl group, a carboxy group, an alkoxycarbonyl group such as a methoxycarbonyl group, an ethoxycarbonyl group and a butoxycarbonyl group); $X_2^-$ and n each has the same meanings as $X_2^-$ and n in the above-described general formula (II).

Particularly useful sensitizing dyes represented by the above-described general formula (II-A) are compounds wherein both $R^{14}$ and $R^{15}$ are a chlorine atom. Those compounds are particularly useful where both $R^{11}$ and $R^{13}$ are a hydrogen atom and in addition, $R^{12}$ is an unsubstituted alkyl group having 4 or less carbon atoms, an alkoxy group having 4 or less carbon atoms or a hydroxy group. Those compounds are particularly useful where $R^{11}$ is a hydrogen atom and in addition, $R^{12}$ forms a benzene ring through combination with $R^{13}$. Those compounds are particularly useful where at least one of $R^4$ and $R^5$ is an alkyl group substituted with a sulfo group.

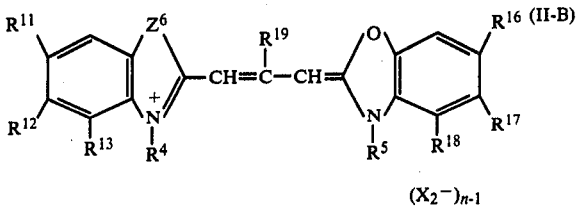

(II-B)

wherein $Z^6$, $R^4$, $R^5$, $R^{11}$, $R^{12}$, $R^{13}$, $X_2^-$ and n each has the same meanings as $Z^6$, $R^4$, $R^5$, $R^{11}$, $R^{12}$, $R^{13}$, $X_2^-$ and n of the above-described general formula (II-A); $R^{16}$, $R^{17}$ and $R^{18}$ each has the same meanings as $R^{11}$, $R^{12}$ and $R^{13}$; $R^{19}$ represents an alkyl group having 4 or less carbon atoms (e.g., a methyl group, an ethyl group, a propyl group, a butyl group, a methoxyethyl group, a phenethyl group, etc.) or a hydrogen atom.

Particularly useful sensitizing dyes represented by the above-described general formula (II-B) are compounds wherein both $R^{18}$ and $R^{16}$ are a hydrogen atom and in addition, $R^{17}$ is a hydrogen atom, a chlorine atom, a phenyl group, an unsubstituted alkyl group having 4 or less carbon atoms or an alkoxy group having 4 or less carbon atoms. Those compounds are particularly useful where $R^{16}$ is a hydrogen atom and in addition, $R^{17}$ and $R^{18}$ combine together to form a benzene ring. Those compounds are particularly useful where both $R^{11}$ and $R^{13}$ are a hydrogen atom and in addition, $R^{12}$ is an unsubstituted alkyl group having 4 or less carbon atoms, an alkoxy group having 4 or less carbon atoms or a hydroxy group. Those compounds are particularly useful where $R^{11}$ is a hydrogen atom and in addition, $R^{12}$ and $R^{13}$ combine together to form a benzene ring. Those compounds are particularly useful where $R^{19}$ is an ethyl group. Those compounds are particularly useful where at least one of $R^4$ and $R^5$ is an alkyl group substituted with a sulfo group.

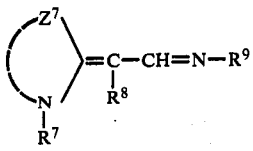

(III-A)

wherein $R^7$, $R^8$ and $R^9$ each has the same meanings as $R^7$, $R^8$ and $R^9$ of the above-described general formula (III); $Z^7$ is an atomic group necessary for forming a benzimidazole nucleus or a naphthimidazole nucleus as represented by $Z^5$ of the above-described general formula (III).

Particularly useful compounds represented by the general formula (III-A) are compounds wherein chlorine atoms are substituents at both 5- and 6-positions of the benzimidazole nucleus formed by $Z^7$. Those compounds are particularly useful where $R^9$ is a phenyl group, a tolyl group, or an anisyl group.

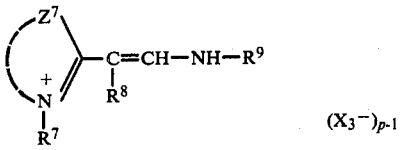

(IV-A)

wherein $Z^7$, $R^7$, $R^8$ and $R^9$ each has the same meanings as $Z^7$, $R^7$, $R^8$ and $R^9$ of the general formula (III-A); and $X_3^-$ and p have the same meanings as $X_3^-$ and p of the general formula (IV).

Specific examples of sensitizing dyes which can be used in the present invention are described below. However, the sensitizing dyes of the present invention should not be construed as being limited to only these compounds.

Specific examples of sensitizing dyes represented by the general formula (I) include the following dyes.

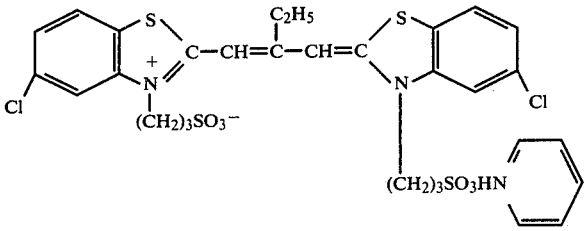

(I - 1)

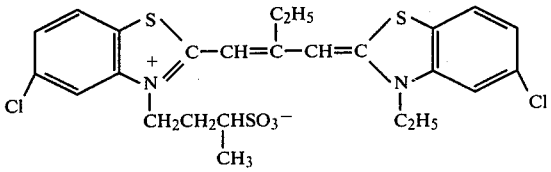

(I - 2)

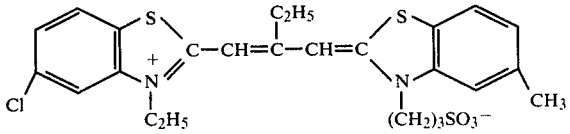

(I - 3)

-continued
(I - 4)
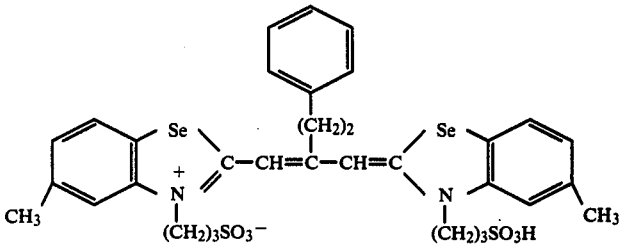
(I - 5)
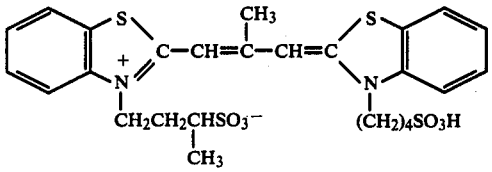
(I - 6)
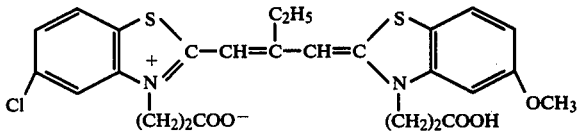
(I - 7)
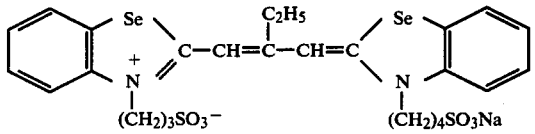
(I - 8)
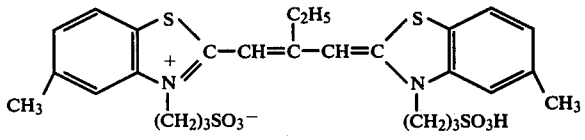
(I - 9)
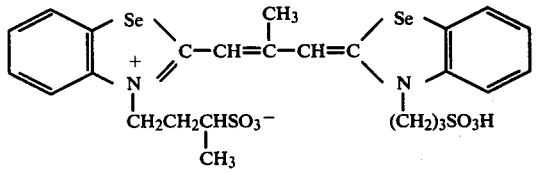
(I - 10)
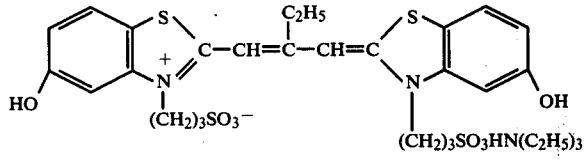
(I - 11)
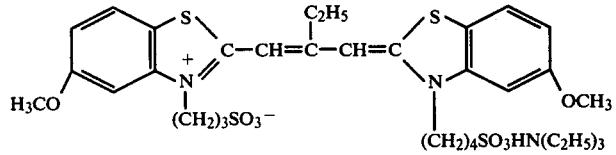
(I - 12)
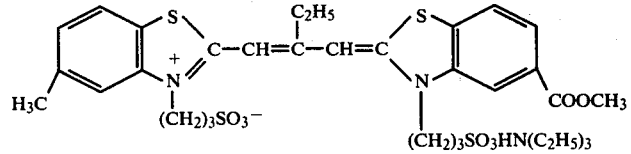
(I - 13)
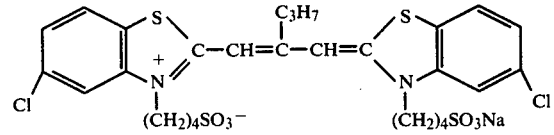

-continued
(I - 14)
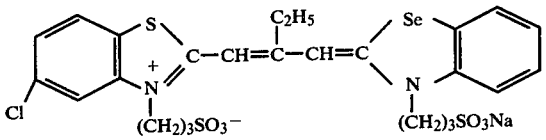
(I - 15)
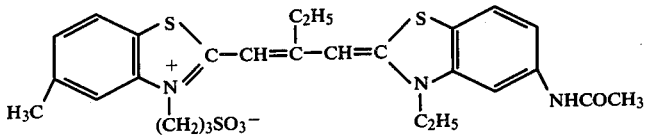
(I - 16)
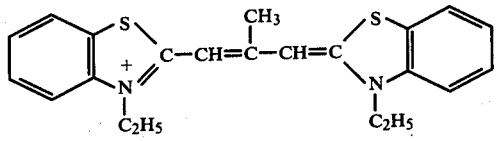
(I - 17)
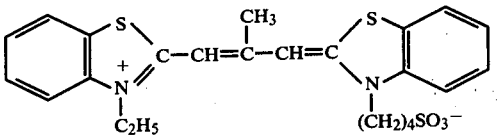
(I - 18)
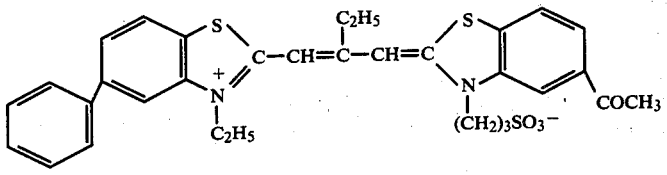
(I - 19)
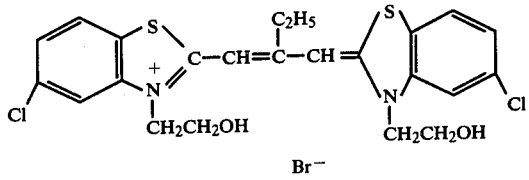
(I - 20)
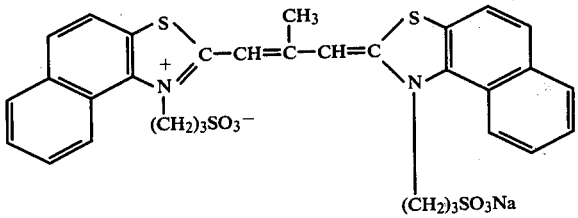
(I - 21)
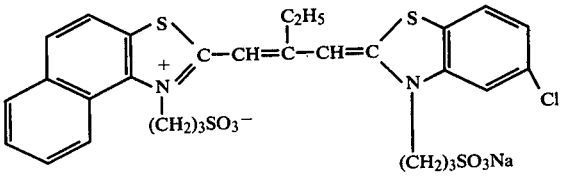
(I - 22)
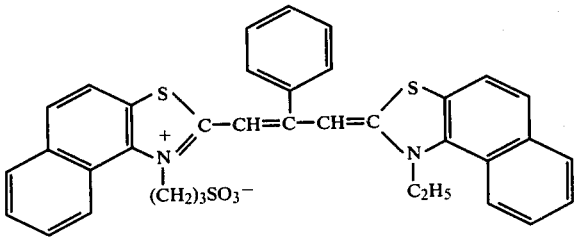

-continued
(I - 23)
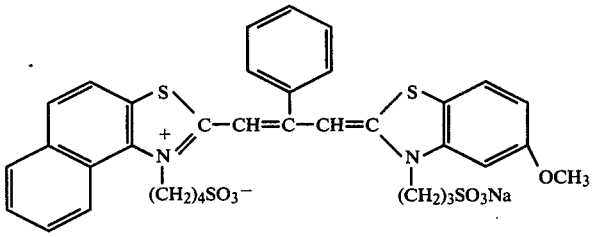
(I - 24)
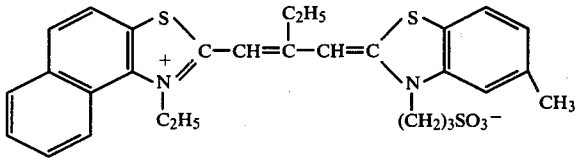
(I - 25)
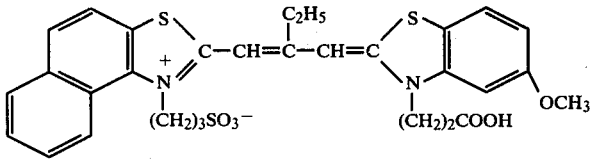
(I - 26)
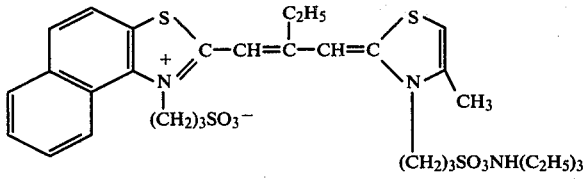
(I - 27)
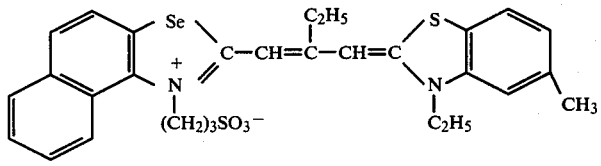
(I - 28)
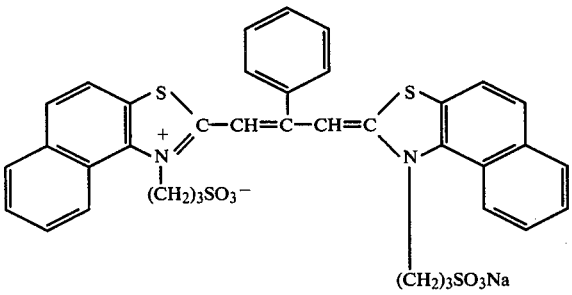
(I - 29)
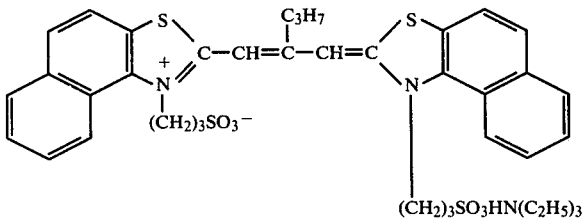
(I - 30)
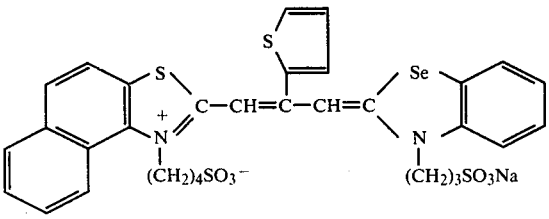

-continued
(I - 31)
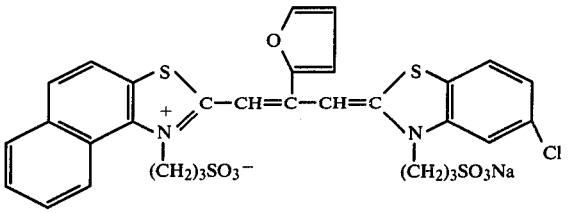
(I - 32)
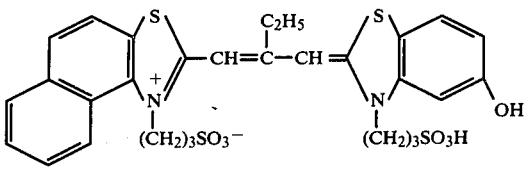
(I - 33)
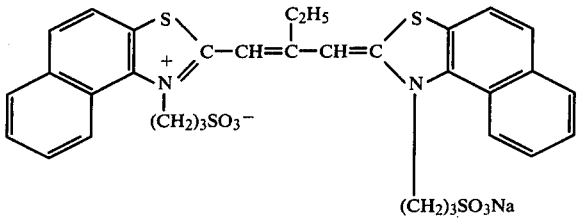
(I - 34)
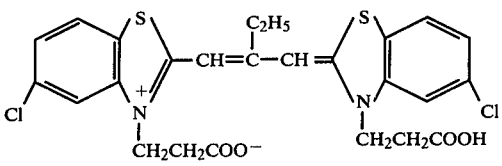
(I - 35)
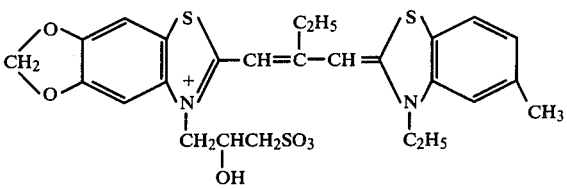
Specific examples of sensitizing dyes represented by the general formula (II) include the following dyes.
(II-1)
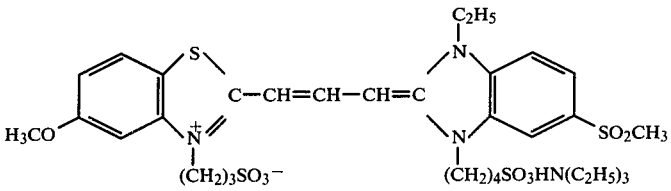
(II-2)
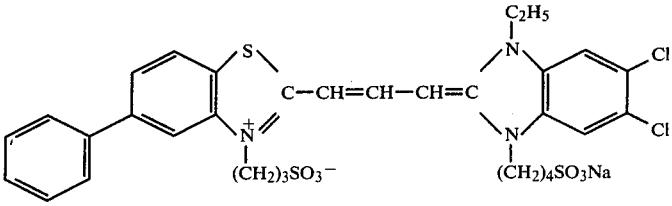
(II-3)
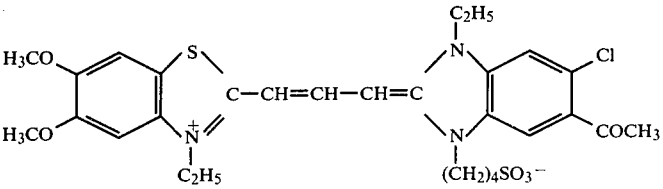

-continued
(II-4)
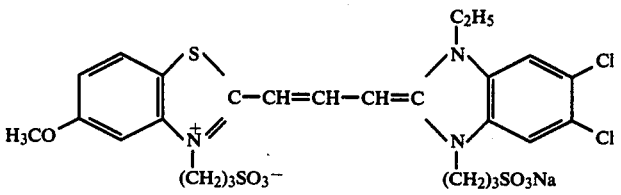
(II-5)
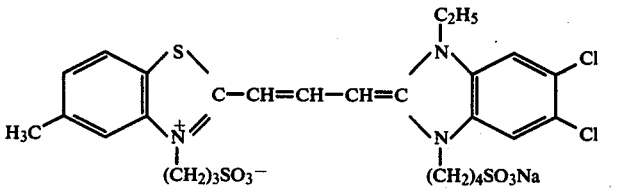
(II-6)
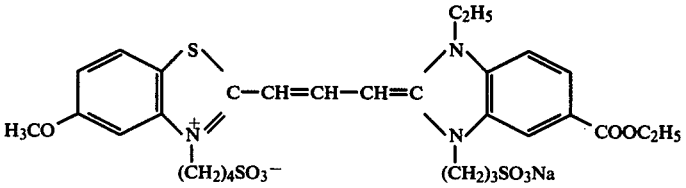
(II-7)
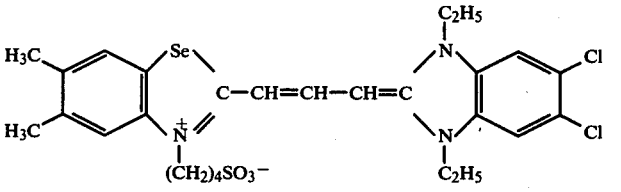
(II-8)
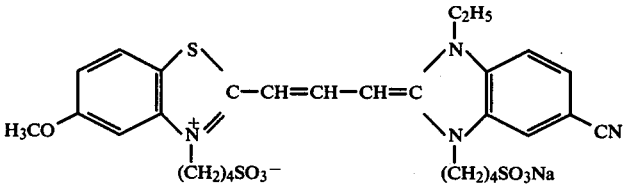
(II-9)
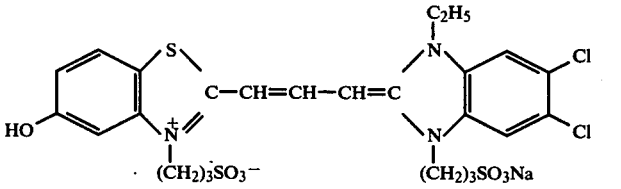
(II-10)
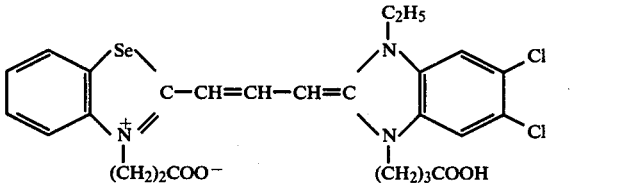
(II-11)
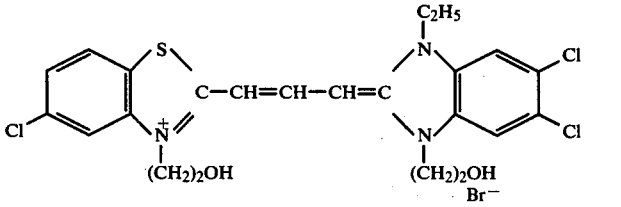
(II-12)
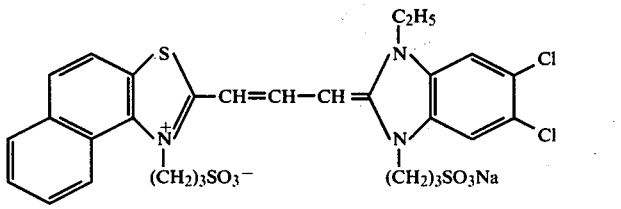

-continued
(II-13)
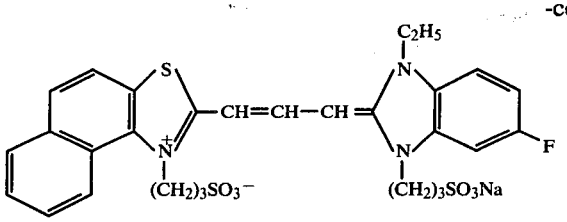
(II-14)
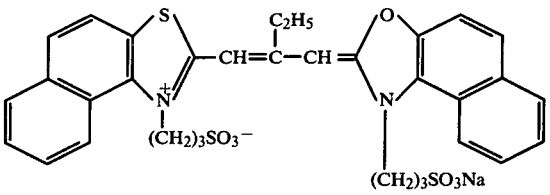
(II-15)
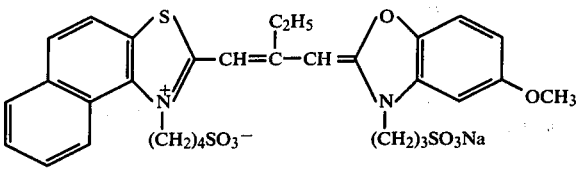
(II-16)
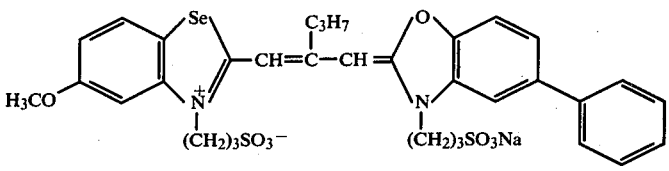
(II-17)
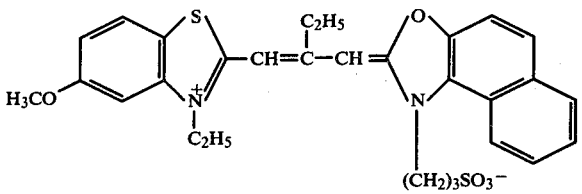
(II-18)
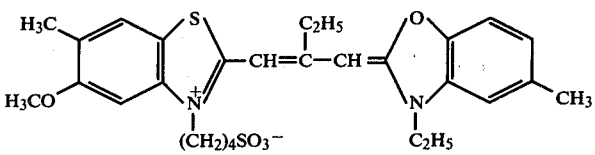
(II-19)
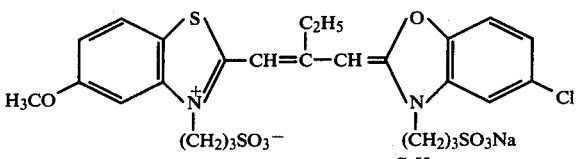
(II-20)
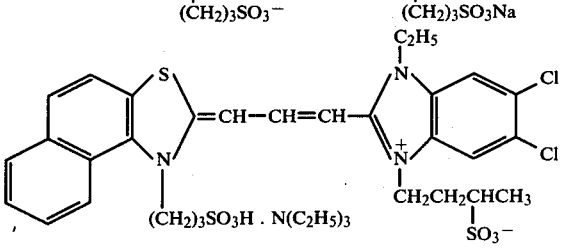
Specific examples of organic heterocyclic ring compounds represented by the general formula (III) include the following compounds.
(III-1)
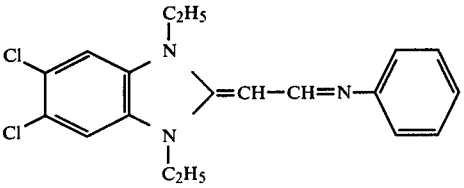
-continued
(III-2)
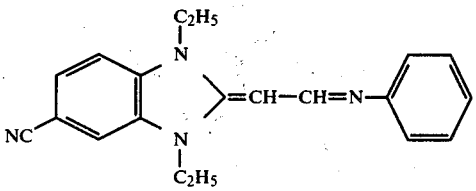

-continued
(III-3)
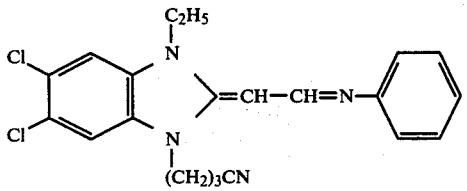
(III-4)
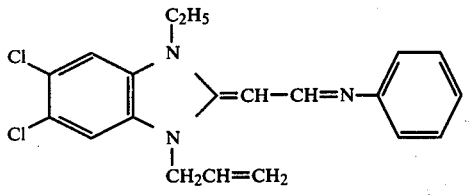
(III-5)
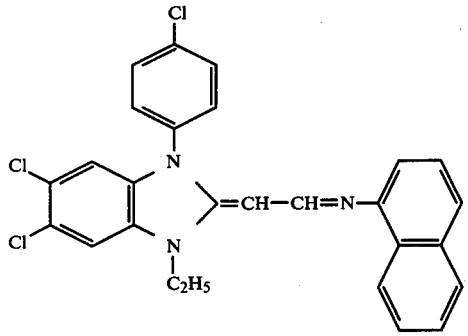
(III-6)
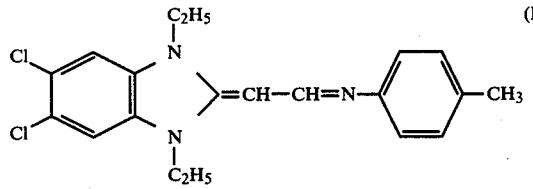
(III-7)
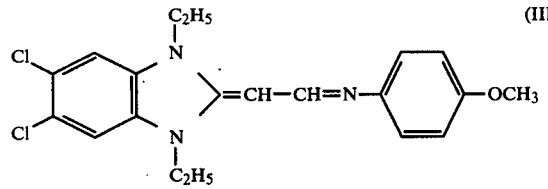
(III-8)
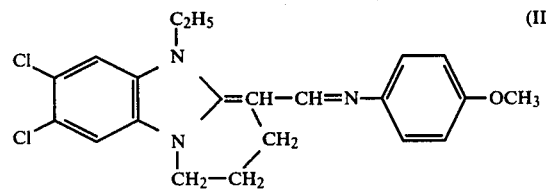
(III-9)
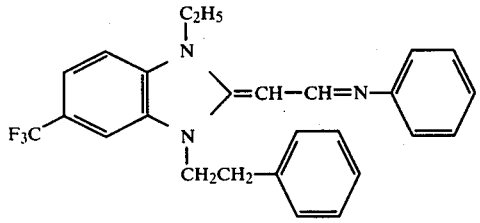
-continued
(III-10)
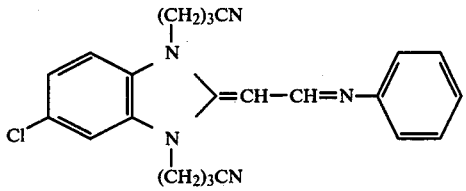
(III-11)
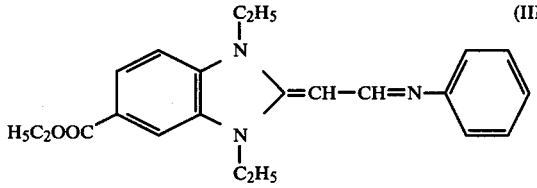
(III-12)
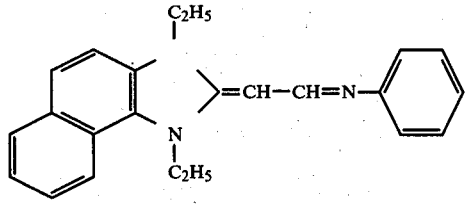
Specific examples of organic heterocyclic ring compounds represented by the general formula (IV) include the following compounds.
(IV-1)
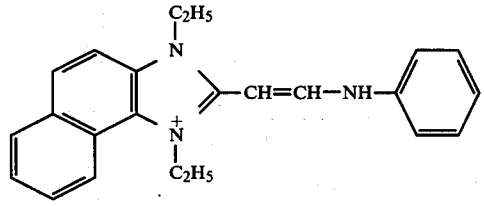
(IV-2)
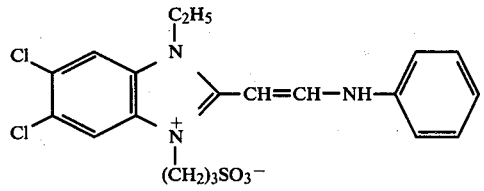
(IV-3)
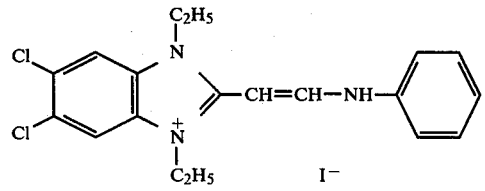
(IV-4)
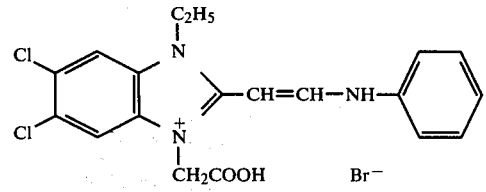

-continued

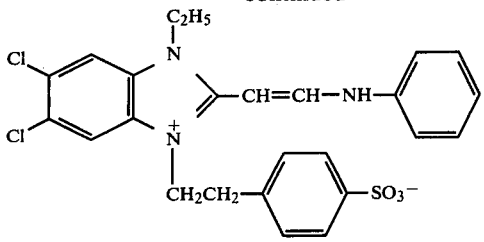

(IV-5)

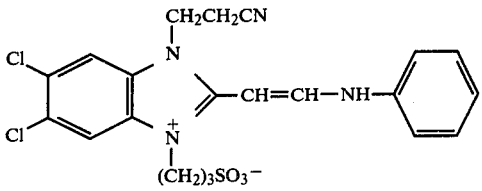

(IV-6)

The sensitizing dyes represented by the general formulas (I) and (II) and the organic heterocyclic ring compounds represented by the general formulas (III) or (IV) utilized in the present invention can be readily synthesized in accordance with known methods as disclosed in many literature references such as F. M. Hamer, *The Cyanine Dyes and Related Compounds,* Interscience Publishers, New York (1964) and in U.S. Pat. No. 3,615,635, corresponding to Japanese Patent Publication No. 1999/71.

The sensitizing dyes and the compounds represented by the general formulas (I), (II), (III) or (IV) are described in U.S. Pat. Nos. 3,705,809, 3,770,449, 3,873,324, 3,432,303, 3,463,640, 3,743,517, 3,617,293, 3,677,765, 3,679,428, 3,729,319, 3,338,714, 3,463,640, 3,931,156 and British Pat. Nos. 1,328,288, 1,323,168, 1,327,808, etc.

The suitable and most economical concentration for any given emulsion will be obvious to one skilled in the art upon making the ordinary tests and observations customarily employed in the art of emulsion making.

The sensitizing dyes and the above-described compounds used in the present invention can be added to the photographic emulsion according to the methods well known in the art.

The sensitizing dyes and the above-described compounds used in the present invention can be directly dispersed into a photographic emulsion or can be added to an emulsion in the form of solutions thereof obtained by previously dissolving the compound in a solvent such as pyridine, methyl alcohol, ethyl alcohol, methyl Cellosolve, acetone, etc., (or a mixture of these solvents) and, if desired, diluting the organic solution with water, or in the form of a solution in water alone. Ultrasonic vibrations can be employed to assist this dissolution. In addition, the methods disclosed in, for instance, Japanese Patent Publications Nos. 8,231/70, 23,389/69, 27,555/69, 22,948/69, German Patent Application (OLS) No. 1,947,935, U.S. Pat. Nos. 3,485,634, 3,342,605, 2,912,343, etc., can also be employed to assist the dissolution.

If desired, each of the sensitizing dyes and the above-described compounds can be separately dissolved in a suitable solvent and then separately incorporated into an emulsion, or they can be separately dissolved in the same solvent or different solvents, and then admixed prior to addition to an emulsion. Further, three or more kinds of solutions each containing the sensitizing dyes can be also separately added to a photographic emulsion.

The compounds each represented by the general formulas (I), (II), (III) and (IV) can be incorporated into a silver halide photographic emulsion in an amount of about $1\times10^{-6}$ mol to about $5\times10^{-3}$ mol, preferably $3\times10^{-6}$ mol to $2.5\times10^{-3}$ mol, particularly preferably $1\times10^{-5}$ mol to $1\times10^{-3}$ mol per mol of silver halide. A suitable molar ratio of the dyes to be used, i.e., the molar ratio of the dye of the general formula (I): the dye of the general formula (II): the compound of the general formula (III) or (IV) to be used is about 0.1 to about 40: about 0.5 to about 20:1, preferably 0.2 to 20:0.5 to 10:1.

Into the photographic emulsion containing the spectrally sensitizing combination of this invention, a supersensitizing compound which is non-sensitizing when used individually or is a material which does not substantially absorb visible light can be also incorporated.

The emulsion, for instance, can contain stilbene compounds having a triazinylamino group or a pyrimidinylamino group (e.g., those as disclosed in U.S. Pat. Nos. 2,933,390 and 3,635,721), aromatic organic acid-formaldehyde condensates (e.g., those as disclosed in U.S. Pat. No. 3,743,510), cadmium salts, azaindenes and the like.

Silver bromide, silver iodobromide, silver iodochlorobromide, silver chlorobromide and silver chloride all may be employed as the silver halide used in the silver halide photographic emulsion of the present invention. The average grain size of silver halide grains incorporated in the photographic emulsion (the grain diameter is defined as the grain size when the grains are spherical in shape or have a substantially spherical shape, and the length of a side is defined as the grain size when the grains are cubic in shape, and the grain size is expressed as the average measured by a projected area method) is preferably 3 or less microns. The distribution of the grain size can be either narrow or broad.

The silver halide photographic emulsions which can be used in the present invention can be produced by methods as described in P. Grafkides, *Chimie Photographique,* Paul Montel Company (1958), and V. L. Zelikman et al., *Making and Coating Photographic Emulsions,* The Focal Press (1964). Methods of preparation which can be used include methods such as a neutral method, an acidic method, an ammoniacal method, a single jet method, a double jet method and a controlled double jet method. The silver halide grains used in this invention can be formed in the presence of excess silver ion and a mixture of two or more different kinds of silver halide emulsions each separately produced and then mixed can be used.

The photographic emulsion used in this invention can be subjected to chemical sensitizing using known methods. Namely, sulfur sensitization using compounds containing sulfur reactive with silver ions such as thiosulfates, allylisothiocyanate, organic compounds having an <N—CS—NH— (e.g., allylthiourea, triethylurea, etc.), thiocyanates or so-called active gelatin; reduction sensitization using reductive compounds such as polyamines, hydrazine derivatives, imino-amino-methane sulfunic acid, stannous salts, silane compounds and so on; gold sensitization using gold complex salts or gold thiosulfate complex salts as disclosed in U.S. Pat. No. 2,399,083; sensitization using salts of a noble metal belonging to Group VIII of the Periodic Table such as platinum, iridium, palladium, rhodium, ruthenium or the like as disclosed in U.S. Pat. Nos. 2,448,060 and 2,540,086, individually or in combination, can be utilized.

The photosensitive emulsions of the present invention can contain a wide variety of compounds for preventing fogging or stabilizing the same during production, storage or processing of the photosensitive material. Namely, many compounds known as an anti-foggant or a stabilizer, for instance, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (1-phenyl-5-mercaptotetrazole in particular) and the like; mercaptopyrimidines; mercaptotriazines; thioketo compounds such as oxazolinethione; azaindenes such as triazaindenes, tetrazaindenes (particularly 4-hydroxy-1,3,3a,7-tetrazaindenes having substituents), pentazaindenes or the like; benzenethiosulfinic acids, benzenesulfonic acids, benzenesulfonic acid amides, and so on can be employed.

The photosensitive emulsions of the present invention may contain organic or inorganic hardeners.

Suitable hardeners which can be used are disclosed in U.S. Pat. Nos. 1,870,354, 2,080,019, 2,579,801, 2,725,295, 2,726,162, 2,983,611, 2,992,109, 3,017,280, 3,047,394, 3,057,723, 3,103,437, 3,288,775, 3,325,287, 3,362,827 and 3,380,829, British Pat. Nos. 676,628, 825,544, 994,869 and 1,167,207, German Pat. Nos. 872,153 and 1,090,427, Japanese Patent Publications Nos. 7133/59, 1872/71 and 38713/71, and so on. The hardener can be used individually or as a combination thereof. The photographic emulsions of the present invention or the light-sensitive materials produced according to the present invention may contain color image forming couplers. It is desirable for the coupler to be non-diffusible. A ballast group such as an alkyl group having at least 8 carbon atoms is generally introduced into the coupler molecule in order to render the coupler diffusion-resistant. The coupler may have a coupling-releasable group bonded to the active carbon atom at the coupling position, if desired.

For instance, open chain ketomethylene compounds such as benzoylacetoanilido compounds and pivaloylacetoanilido compounds can be used as yellow dye-forming couplers. Pyrazolone compounds, indazolone compounds and cyanoacetyl compounds can be used as magenta dye-forming couplers. Phenol derivatives and naphthol derivatives can be used as cyan dye-forming couplers. A coupler which releases a development-inhibiting compound at the time of coupling may be used and a compound which releases a development-inhibiting compound at the time of the coupling may be added to a photographic emulsion.

The above-described couplers can be incorporated into a photographic emulsion layer using known methods. For instance, a method which comprises dissolving the coupler into an organic solvent having a boiling point of about 180° C. or higher (e.g., dibutyl phthalate, etc.) or into an organic solvent having a low boiling point (e.g., ethyl acetate, etc.) and then dispersing the solution in a hydrophilic colloid can be used. Where the coupler has an acidic group such as a carboxylic acid or a sulfonic acid group, the coupler can be introduced into a hydrophilic colloid as an alkaline solution thereof.

The photographic emulsion layers and other hydrophilic colloid layers in the light-sensitive material produced according to the present invention can contain a developing agent, individually or a combination thereof. Suitable developing agents include, for example, dihydroxybenzenes (e.g., hydroquinone, etc.), 3-pyrazolidones (e.g., 1-phenyl-3-pyrazolidone, etc.), pyrogallol, ascorbic acid and phenylenediamines.

The photographic emulsion layers or other hydrophilic colloid layers in the light-sensitive material produced according to the present invention may contain a water-soluble dye as a filter dye or for the purposes of irradiation-prevention and other purposes. These dyes include oxonol dyes, hemioxonol dyes, styryl dyes, merocyanine dyes, cyanine dyes and azo dyes. Of these dyes which are particularly valuable are oxonol dyes, hemioxonol dyes and the merocyanine dyes. The dyes may be mordanted in a specific layer using a cationic polymer such as dialkylaminoalkylacrylate.

The photographic emulsion layers or other hydrophilic colloid layers in the light-sensitive material according to the present invention may contain a plasticizer such as glycerin, diols as disclosed in U.S. Pat. No. 2,960,404, trihydric aliphatic alcohols as disclosed in U.S. Pat. No. 3,520,694 and the like.

The photographic emulsion layers or other hydrophilic colloid layers in the light-sensitive material according to the present invention may contain a brightening agent of the stilbene series, the triazine series, the oxazole series, the coumarin series or the like. Water-soluble brightening agents can be used, and, in addition, water-insoluble brightening agents can be used in the form of a dispersion thereof.

A variety of known surface active agents can be added, as a coating aid or for antistatic purposes, for improvement of sliding properties and other purposes, to the photographic emulsion layers or other hydrophilic colloid layers in the light-sensitive material produced according to the present invention. Examples of the surface active agents which can be used include saponin, alkylbenzenesulfonate or surface active agents as disclosed in U.S. Pat. Nos. 2,240,472, 2,831,766, 3,158,484, 3,210,191, 3,294,540 and 3,507,660, British Pat. Nos. 1,012,495, 1,022,878, 1,179,290 and 1,198,450, Japanese Patent Application (OPI) No. 117,414/75, U.S. Pat. Nos. 2,739,891, 2,823,123, 3,068,101, 3,415,649, 3,666,478 and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publications Nos. 378/65, 379/65 and 13,822/68, U.S. Pat. Nos. 2,271,623, 2,288,226, 2,944,900, 3,253,919, 3,671,247, 3,772,021, 3,589,906, 3,666,478 and 3,754,924, West German Patent Application (OLS) No. 1,961,638, Japanese Patent Application (OPI) No. 59,025/75, etc.

The photographic emulsion layers or other hydrophilic colloid layers in the light-sensitive material produced according to the present invention may contain an ultraviolet light absorbing agent such as compounds belonging to the benzophenone series, benzotriazole series, benzoxazole series, thiazolidone series, cinnamic acid ester series, etc. These ultraviolet light absorbing agents may be mordanted to a specific layer, if desired.

In the light-sensitive material produced in accordance with the present invention, the hydrophilic colloidal layers may contain compounds which are added to color light-sensitive materials for the purpose of preventing color fog or preventing color contamination between layers, and which include, for example, alkyl hydroquinones, di-alkyl hydroquinones, aryl-substituted hydroquinones, sulfo-substituted hydroquinones, high molecular weight compounds having a hydroquinone residue, catechol derivatives, aminophenol derivatives, gallic acid derivatives, ascorbic acids and the like in the form of a dispersion thereof depending on the circumstances. These compounds can be introduced into a hydrophilic colloid layer in the same manner as the couplers described earlier.

In the light-sensitive material produced in accordance with the present invention, the hydrophilic colloid layers, particularly an uppermost layer, may contain a lubricating agent such as higher alcohol esters of higher fatty acids, casein, higher fatty acid calcium salts, silicone compounds and a dispersion of liquid paraffin.

The hydrophilic colloid layers in the light-sensitive material produced according to the present invention can contain a matting agent such as particles of an inorganic material, e.g., silica, glass powder, carbonates of alkaline earth metals, cadmium carbonate, zinc carbonate and the like; and particles of an organic material, e.g., starch, starch derivatives, polyvinyl alcohol, polystyrene, polymethylmethacrylate, polyacrylonitrile and polycarbonates.

Gelatin is generally employed as a hydrophilic colloid which is used as a binding agent or protective colloid of the photographic emulsion. A part or all of the hydrophilic colloid can be replaced by proteins such as gelatin derivatives, graft polymers of gelatin and other high molecular weight compounds, albumin, casein and the like; cellulose derivatives such as hydroxyethyl cellulose, carboxymethyl cellulose and the like; polysaccharides such as agar-agar, sodium alginate, starch derivatives and the like; and a variety of synthetic hydrophilic high molecular weight compounds, e.g., homo- or copolymers such as polyvinyl alcohol partial acetal, poly-N-vinylpyrrolidone, polyacrylic acid, polyacrylamide, polyvinylimidazole, polyvinylpyrazole, etc.

The above-described gelatin derivatives which can be used can be obtained by reacting gelatin with, for instance, acid anhydrides, acyl halides, acid esters, isocyanates, maleimides, vinylsulfonamides, epoxy compounds and the like.

Examples of the above-described gelatin-graft polymers include graft-products of gelatin and homo- or copolymers of vinyl monomers such as acrylic acid, methacrylic acid and their derivatives, e.g., the esters, amides, etc., acrylonitrile, styrene and the like. Polymers at least somewhat compatible with gelatin are particularly preferred, i.e., graft polymers of gelatin and polymers derived from, for instance, acrylic acid, methacrylic acid, acrylamide, methacrylamide, hydroxyalkyl (meth)acrylate and the like.

Suitable supports for the light-sensitive material produced according to the present invention which can be used include any transparent or opaque supports conventionally used for photographic material, for instance, films comprising synthetic high molecular weight materials such as polyesters or polyamides, e.g., polyalkyl(meth)acrylates, polystyrenes, polyvinyl chlorides, polycarbonates, polyethylene terephthalate, etc., films comprising cellulose derivatives, e.g., cellulose nitrate, cellulose acetate, cellulose acetate butyrate, etc., paper, baryta coated paper, paper coated with an $\alpha$-olefin or the like, synthetic papers comprising polystyrene and the like, glass, ceramics, metal, and the like.

Exposure can be carried out in a conventional manner. Namely, light from a wide variety of known light sources including natural light (sunlight), a tungsten lamp, a fluorescent lamp, a mercury lamp, a xenon arc lamp, a carbon arc lamp, a xenon flash lamp, a cathode ray tube flying spot and the like can be used for exposure. Not only exposure times commonly used in taking a photographs with the average camera, i.e., times ranging from about 1/1,000 sec. to about 1 sec., but also exposure times shorter than about 1/1,000 sec., for example, exposure times ranging from about $1/10^4$ sec. to about $1/10^6$ sec. achieved using a xenon flash lamp or a cathode ray tube display, and further, exposure times longer than 1 sec. can be all employed. The spectral composition of the light used for exposure can be optionally controlled by the use of color filters, if desired. Laser light can be also employed for exposure, if desired.

The light-sensitive materials produced according to the present invention can be subjected to photographic processings using known methods. Known processing solutions can be used. Processing temperatures generally range from about 18° C. to about 50° C., but temperatures lower than about 18° C. or higher than about 50° C. can also be chosen for certain processings.

Either developing processing for forming silver images (black-and-white photographic processing) or color photographic processing comprising developing processing for forming a dye image can be employed depending upon the uses of the light-sensitive materials produced in accordance with the present invention.

The photographic emulsion of the present invention can be subjected to so-called "lithographic type" processing, if desired.

Conventional procedures can be used to produce a dye image in accordance with the present invention. For example, the negative-positive method, the color reversal method comprising producing a negative silver image by developing the exposed light-sensitive material with a developing solution containing a black-and-white developing agent and then subjecting the material to a uniform exposure to light at least one time or another appropriate fogging treatment, followed by color development to result in the formation of a positive dye image and a like method can be employed.

A combination of the sensitizing dyes according to the present invention can be used for the sensitization of various silver halide photographic emulsions for color photographic and black-and-white photograhic light-sensitive materials. Examples of emulsions which can be used include those used for color positive films, color papers, color negative films, color reversal films (containing or not-containing couplers), light-sensitive materials for lithography (for instance, photo lithographic films and the like), light-sensitive materials for cathode ray tube displays, X-ray recording light-sensitive materials (in particular, materials for direct radiography and fluorography employing an X-ray intensifying screen), a colloid transfer process (e.g., those as disclosed in, for example, U.S. Pat. No. 2,716,059), a silver salt diffusion transfer process (e.g., those as disclosed in, for instance, U.S. Pat. Nos. 2,352,014, 2,543,181, 3,020,155 and 2,861,885), a color diffusion transfer process (e.g., those as disclosed in, for instance, U.S. Pat. Nos. 3,087,817, 3,185,567, 2,983,606, 3,253,915, 3,227,550, 3,227,551, 3,227,552, 3,415,644, 3,415,645 and 3,415,646), a dye transfer process (imbibition transfer process) (e.g., those as disclosed in, for instance, U.S. Pat. No. 2,882,156), a silver-dye bleaching process (e.g., those as disclosed in Friedman, *History of Color Photography,* particularly Chapter 24, American Photographic Publishers Co., (1944), and *British Journal of Photography,* Vol. 111, pp. 308–309 (Apr. 7, 1964)), thermally developable light-sensitive materials (e.g., those as disclosed in, for instance, U.S. Pat. Nos. 3,152,904, 3,312,550 and 3,148,122, British Pat. No. 1,110,046), light-sensitive materials for physical development (e.g., those as disclosed in, for instance, British Pat. Nos. 920,277 and 1,131,238).

The supersensitization technique according to the present invention is particularly useful for the production of photographic emulsions for multilayer "coupler-in-emulsion type" color materials, more particularly reversal color and negative color films, highly sensitive negative films, micronegative films and lithographic light-sensitive materials for photolithography.

The present invention will be illustrated further by reference to the following examples. Unless otherwise indicated herein, all parts, percents, ratios and the like are by weight.

EXAMPLE 1

Silver halide grains were precipitated using the single jet method, subjected to physical ripening, desalted and chemically ripened to obtain a silver iodobromide emulsion (iodide content: 8 mol%). The silver halide grains present in this emulsion had a mean diameter of 1.3 microns. This emulsion contained 0.7 mol of silver halide per kg of the emulsion.

1 kg portions of this emulsion were each weighed out into pots, which were then placed in a thermostatic bath at 50° C. to melt the emulsion. Methanol solutions of the sensitizing dyes of the present invention were added to the emulsion portions in predetermined amounts, and mixed and stirred in a thermostatic bath at 40° C. To each emulsion portion were added 10 ml of a 1% by weight aqueous solution of 4-hydroxy-6-methyl-1,3,3a,7-tetrazaindene and 20 ml of a 1% by weight aqueous solution of 2-hydroxy-4,6-dichlorotriazine sodium salt, and the system stirred. Each of the thus finished emulsion portions was coated on a cellulose triacetate film support in a dry thickness of 5 microns and then dried. Thus, samples of light-sensitive materials were obtained. One of the samples was exposed wedgewise using a sensitometer with a light source of a color temperature of 5,400° K., covered with a red filter (SC-56) manufactured by Fuji Photo Film Co., Ltd., or a blue filter (Wratten-47 B) manufactured by Eastman Kodak Co. The intensity of illumination was 800 lux and the exposure time was 1/200 sec.

The other sample was exposed for the purpose of obtaining a spectrogram using a uniform energy-spectrographic camera manufactured by Fuji Photo Film Co., Ltd. The thus exposed samples were developed at 20° C. for 2 minutes using a developer having the following composition, followed by stopping, fixing and washing. The photographic density was measured by using a P-type densitometer (manufactured by Fuji Photo Film Co., Ltd.) to obtain the red filter sensitivity ($S_R$) and the blue filter sensitivity ($S_B$). The standard point used to determine the sensitivity was an optical density of fog+0.20.

| Composition of the Developer | | |
|---|---|---|
| Water | 700 | ml |
| Metol | 2.2 | g |
| Sodium Sulfite (anhydrous) | 96 | g |
| Hydroquinone | 8.8 | g |
| Sodium Carbonate (monohydrate) | 56 | g |
| KBr | 5 | g |
| Water to make | 1 | l |

The results obtained are shown in Table 1 below with Test No. 1-1 being a control.

TABLE 1

| Test No. | Sensitizing Dyes and Amounts Used × $10^{-5}$ mol | | | | | | | | $S_R$ | $S_B$ | Fog |
|---|---|---|---|---|---|---|---|---|---|---|---|
| 1-1 | — | | — | | — | | — | | — | 100 | 0.05 |
| 2* | (I-9) | 8 | — | | (II-12) | 2 | (IV-1) | 2 | 186 | 92 | 0.05 |
| 3* | | 8 | — | | | 4 | | 2 | 204 | 86 | 0.05 |
| 2-1* | (I-8) | 8 | (I-28) | 1 | (II-12) | 2 | (III-1) | 1 | 210 | 96 | 0.05 |
| 2* | | 8 | | 1 | | 4 | | 1 | 240 | 96 | 0.05 |
| 3** | — | | — | | | 4 | | 1 | 122 | 98 | 0.05 |
| 4** | — | | — | | | 4 | — | | 89 | 100 | 0.05 |
| 3-1* | (I-8) | 8 | — | | (II-17) | 2 | (III-1) | 1 | 195 | 96 | 0.05 |
| 2* | | 8 | — | | | 4 | | 1 | 204 | 92 | 0.05 |
| 4-1* | (I-3) | 8 | (I-33) | 0.5 | (II-12) | 2 | (IV-3) | 1 | 214 | 96 | 0.05 |
| 2* | | 8 | | 0.5 | | 2 | | 2 | 214 | 88 | 0.05 |
| 5-1** | (I-3) | 8 | (I-33) | 0.5 | — | | (IV-3) | 1 | 138 | 96 | 0.05 |
| 2** | | 8 | | 0.5 | — | | | 2 | 132 | 85 | 0.05 |
| 6-1* | (I-6 | 8 | — | | (II-15) | 2 | (III-1) | 1 | 160 | 92 | 0.05 |
| 2* | | 8 | — | | | 4 | | 1 | 174 | 88 | 0.05 |
| 7-1** | (I-6) | 8 | — | | — | | (III-1) | 1 | 100 | 96 | 0.05 |

*This invention
**For comparison

The sensitivities $S_R$ and $S_B$ are each shown as relative sensitivities, assuming that the value obtained in Test No. 7-1 was 100, and that the value obtained in Test No. 1-1 without any sensitizing dye was 100, respectively. An advantage of the present invention will be understood by each comparing Test No. 4 or 6 with Test No. 5 or 7 for comparison wherein a member of the dye-combination is absent, respectively.

EXAMPLE 2

80 g of 1-hydroxy-N-[γ-(2,4-di-tert-amylphenoxypropyl)]-2-naphthamide was thoroughly dissolved in a mixed solution of 100 ml of tricresyl phosphate and 50 ml of ethyl acetate, to which 2 g of sorbitan monolaurate was further added. The resulting solution was added to 1 kg of a 10% by weight aqueous solution of gelatin containing 2.5 g of dodecylbenzene sulfonic acid, stirred at high speed and then further stirred using ultrasonic waves. An emulsion was thus obtained. 1 kg portions of a silver iodobromide emulsion produced by the method described in Example 1 were then separately weighed out into pots and placed in a 50° C. thermostatic bath to melt the emulsion.

Methanol solutions of the sensitizing dyes of the present invention and sensitizing dyes for comparison as shown in Table 2 below were added to the emulsion portions in predetermined amounts, and the system mixed and stirred at 40° C., and allowed to stand for 15 minutes. To each emulsion portion were added 300 g of the above-described emulsion, 10 ml of a 1% by weight aqueous solution of 4-hydroxy-6-methyl-1,3,3a,7-tetrazaindene and further 10 ml of a 1% by weight aqueous solution of 2-hydroxy-4,6-dichlorotriazine sodium salt and moreover 10 ml of a 1% by weight aqueous solution of sodium dodecylbenzene sulfonate, and then the mixture stirred.

Each of the thus finished emulsion portions was coated on a cellulose triacetate film support to provide a dry thickness of 5 microns and dried, and then a protective layer mainly composed of gelatin was additionally applied thereon to provide a dry thickness of 1 micron and dried. One piece of these film samples was each wedge-wise exposed using the sensitometer described in Example 1, covered by a red filter (SC-56) made by Fuji Photo Film Co., Ltd.

The intensity of illumination was 800 lux and the exposure time was 1/200 second. The other piece of these samples was each exposed to obtain a spectrogram using the above-described spectrographic camera. Further, another piece of the samples was each allowed to stand for 3 days at 50° C. and a relative humidity of 70% in order to investigate the stability with the lapse of time, after the production of the light-sensitive materials. As a result, substantially no change in stability was observed.

These samples were subjected to a development processing at 38° C. according to the following color negative developing process.

| | |
|---|---|
| 1. Color Development | 3 min 15 sec |
| 2. Bleaching | 6 min 30 sec |
| 3. Washing | 3 min 15 sec |
| 4. Fixing | 6 min 30 sec |
| 5. Washing | 3 min 15 sec |
| 6. Stabilizing | 3 min 15 sec |

The processing solutions each used in the above-described steps had the following compositions.

| | | |
|---|---|---|
| Color Developer | | |
| Sodium Nitrilotriacetate | 1.0 | g |
| Sodium Sulfite | 4.0 | g |
| Sodium Carbonate | 30.0 | g |
| Potassium Bromide | 1.4 | g |
| Hydroxylamine Sulfate | 2.4 | g |
| 4-(N-Ethyl-N-β-hydroxyethylamino)-2-methylaniline Sulfate | 4.5 | g |
| Water to make | 1 | l |
| Bleaching Solution | | |
| Ammonium Bromide | 160.0 | g |
| Ammonia (28 wt% aq. soln.) | 25.0 | ml |
| Sodium Salt of (Ethylenediaminetetraacetate)iron (III) | 130.0 | g |
| Glacial Acetic Acid | 14.0 | ml |
| Water to make | 1 | l |
| Fixing Solution | | |
| Sodium Tetrapolyphosphate | 2.0 | g |
| Sodium Sulfite | 4.0 | g |
| Ammonium Thiosulfate (70 wt% aq. soln.) | 175.0 | ml |
| Sodium Bisulfite | 4.6 | g |
| Water to make | 1 | l |
| Stabilizing Solution | | |
| Formaldehyde (40% aq. soln.) | 8.0 | ml |
| Water to make | 1 | l |

The thus obtained strips were subjected to densitometry using a P-type densitometer made by Fuji Photo Film Co., Ltd. The relative sensitivity and the fog density due to undesirable cyan coloration were measured. The standard point of the optical density to determine sensitivity was fog+0.20.

The results obtained are shown in Table 2, where the sensitivity is shown as a relative value.

TABLE 2

| Test No. | Sensitizing Dyes and Amount Used × $10^{-5}$ mol | | | | | | | | $S_R$ Relative Value | Cyan Fog |
|---|---|---|---|---|---|---|---|---|---|---|
| 8-1* | (I-1) | 8 | (I-33) | 0.5 | (II-12) | 2 | (III-5) | 1 | 226 | 0.07 |
| 2* | | 8 | | 0.5 | | 4 | | 1 | 235 | 0.07 |
| 3* | | 8 | — | | | 4 | | 1 | 204 | 0.07 |
| 9-1* | (I-1) | 8 | (I-33) | 0.5 | (II-4) | 2 | (III-1) | 1 | 222 | 0.07 |
| 2* | | 8 | | 0.5 | | 4 | | 1 | 240 | 0.07 |
| 3** | — | | — | | | 2 | | 1 | 42 | 0.07 |
| 4** | — | | — | | | 2 | — | | 30 | 0.07 |
| 10-1* | (I-1) | 8 | (I-33) | 0.5 | (II-10) | 2 | (III-1) | 1 | 208 | 0.07 |
| 2* | | 8 | | 0.5 | | 4 | | 2 | 208 | 0.07 |
| 11-1* | (I-1) | 8 | (I-28) | 0.5 | (II-12) | 2 | (III-1) | 1 | 250 | 0.07 |
| 2* | | 8 | | 1 | | 2 | | 1 | 250 | 0.07 |
| 12-1* | (I-9) | 8 | (I-28) | 0.5 | (II-17) | 2 | (IV-3) | 1 | 185 | 0.07 |
| 2* | | 8 | | 0.5 | | 4 | | 1 | 200 | 0.07 |
| 13-1* | (I-8) | 6 | (I-20) | 0.5 | (II-12) | 2 | (IV-1) | 1 | 185 | 0.07 |
| 2* | | 8 | | 0.5 | | 2 | | 1 | 197 | 0.07 |
| 3* | | 12 | | 0.5 | | 2 | | 1 | 190 | 0.08 |
| 14-1* | (I-2) | 8 | — | | (II-2) | 2 | (IV-2) | 2 | 214 | 0.07 |
| 2* | | 8 | — | | | 4 | | 2 | 214 | 0.07 |
| 3* | | 8 | — | | | 6 | | 2 | 210 | 0.08 |
| 15-1** | — | | — | | (II-2) | 2 | (IV-2) | 2 | 32 | 0.07 |
| 2** | (I-2) | 8 | — | | — | | | 2 | 100 | 0.07 |
| 16-1* | (I-2) | 8 | (I-33) | 0.5 | (II-19) | 2 | (III-6) | 2 | 220 | 0.07 |
| 2* | | 8 | | 0.5 | | 4 | | 2 | 228 | 0.07 |
| 17-1** | (I-34) | 8 | (I-33) | 0.5 | (II-20) | 2 | (A) | 2 | 146 | 0.07 |
| 2** | | 8 | | 0.5 | | 2 | | 4 | 140 | 0.07 |

*This Invention
**For Comparison

The structural formula of the dye employed for comparison in this example is given below.

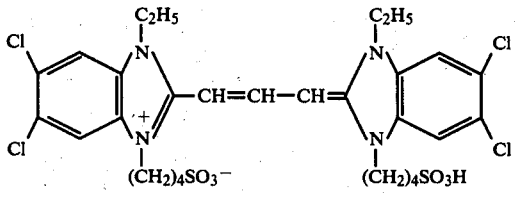

(A)

In the above table, $S_R$ is a relative sensitivity, assuming that the value obtained in Test No. 15-2 is 100. An advantage of the present invention will be seen from the comparison between Test No. 14 and Test No. 15, where in Test No. 15 one of sensitizing dyes used in the dye-combination is excluded. Further, an advantage of the present invention will be understood, as compared to Test No. 17 for comparison wherein the dye-combination represents those as described in U.S. Pat. No. 3,672,878, corresponding to Japanese Patent Publication No. 6207/74.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing a combination of at least one sensitizing dye represented by the following general formula (I):

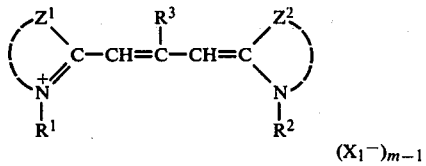

(I)

at least one sensitizing dye represented by the following general formula (II):

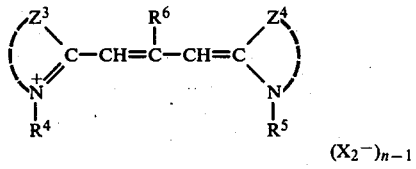

(II)

and at least one organic heterocyclic compound represented by the following general formula (III) or (IV):

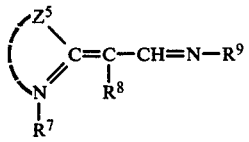

(III)

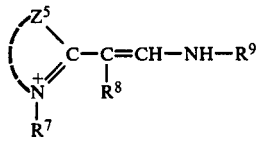

(IV)

wherein $Z^1$ and $Z^2$, which may be the same or different, each represents a group of atoms necessary for forming a thiazole nucleus or a selenazole nucleus; $Z^3$ has the same meaning as $Z^1$ and $Z^2$; $Z^4$ represents a group of atoms necessary for forming an imidazole nucleus or an oxazole nucleus; $Z^5$ represents a group of atoms necessary for forming an imidazole nucleus; $R^1$, $R^2$, $R^4$, $R^5$ and $R^7$, which may be the same or different, each represents an alkyl group, with at least one of $R^1$, $R^2$, $R^4$ and $R^5$ being an alkyl group substituted with a carboxy group, a hydroxy group or a sulfo group; $R^3$ and $R^6$, which may be the same or different, each represents a lower alkyl group, an aryl group or a hydrogen atom; $R^8$ represents a hydrogen atom or an alkylene group necessary for forming a ring on combination with $R^7$; $R^9$ represents a monocyclic aryl group or a bicyclic aryl group; $X_1^-$, $X_2^-$ and $X_3^-$ each represents an acid anion; m, n and p each represents 1 or 2, but when m, n and/or p is 1, the dye forms an intramolecular salt.

2. The silver halide photographic emulsion as claimed in claim 1, containing a combination of at least one sensitizing dye represented by the general formula (I), at least one sensitizing dye represented by the following general formula (II-A):

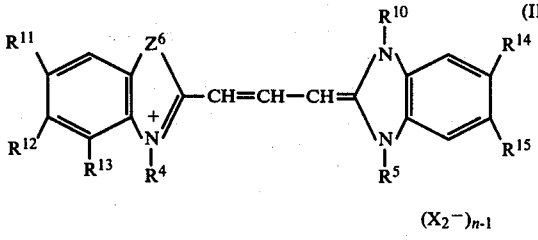

(II-A)

wherein $Z^6$ represents a sulfur atom or selenium atom; $R^4$, $R^5$ and $R^{10}$ each has the same meaning as $R^4$ and $R^5$ of the above-described general formula (II); $R^{11}$ and $R^{12}$ each represents a halogen atom, an alkyl group having 4 or less carbon atoms, an alkoxycarbonyl group having 5 or less carbon atoms; a carboxy group; a hydroxy group; an acylamino group; a phenyl group; an alkoxy group having 4 or less carbon atoms or a hydrogen atom; $R^{11}$ and $R^{12}$ may combine together to form a benzene ring or a dioxymethylene chain; $R^{13}$ represents a hydrogen atom or can form a benzene ring on combination with $R^{12}$; $R^{14}$ and $R^{15}$ each represents a hydrogen atom or an electron attracting group; $X_2^-$ and n each has the same meaning as $X_2^-$ and n of the above-described general formula (II); and at least one compound represented by the following general formula (III-A):

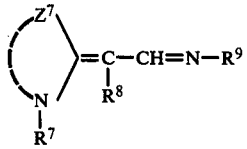

(III-A)

wherein $R^7$, $R^8$ and $R^9$ each has the same meaning as $R^7$, $R^8$ and $R^9$ of the general formula (III); $Z^7$ represents an atomic group necessary for forming a benzimidazole nucleus or a naphthoimidazole nucleus; or (IV-A):

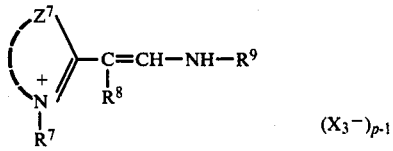

(IV-A)

wherein $Z^7$, $R^7$, $R^8$ and $R^9$ each has the same meaning as $Z^7$, $R^7$, $R^8$ and $R^9$ of the above-described general formula (III-A); $X_3^-$ and p each has the same meaning as $X_3^-$ and p of the above-described general formula (IV).

3. The silver halide photographic emulsion as claimed in claim 1, containing a combination of at least one sensitizing dye represented by the general formula (I), at least one sensitizing dye represented by the following general formula (II-B):

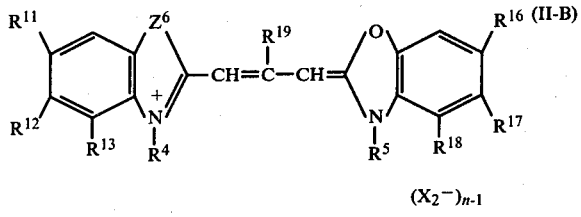

(II-B)

wherein $Z^6$, $R^4$, $R^5$, $R^{11}$, $R^{12}$, $R^{13}$, $X_2^-$ and n each has the same meaning as those of the above-described general formula (II-A), respectively; $R^{16}$, $R^{17}$ and $R^{18}$ each has the same meaning as $R^{11}$, $R^{12}$ and $R^{13}$, respectively; and $R^{19}$ represents an alkyl group having 4 or less carbon atoms or a hydrogen atom; and at least one compound represented by the general formula (III-A) or (IV-A):

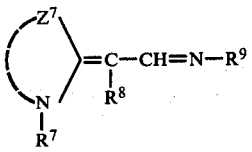

(III-A)

wherein $R^7$, $R^8$ and $R^9$ each has the same meaning as $R^7$, $R^8$ and $R^9$ of the general formula (III); $Z^7$ represents an atomic group necessary to form a benzimidazole nucleus or a naphthoimidazole nucleus;

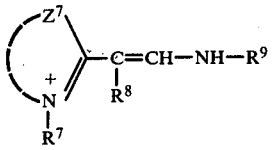

(IV-A)

wherein $Z^7$, $R^7$, $R^8$ and $R^9$ each has the same meaning as $Z^7$, $R^7$, $R^8$ and $R^9$ of the above-described general formula (III-A); $X_3^-$ and p each has the same meaning as $X_3^-$ and p of the above-described general formula (IV).

4. The silver halide photographic emulsion as claimed in claim 1, containing a combination of at least two sensitizing dyes represented by the general formula (I), at least one sensitizing dye represented by the general formula (II) and at least one organic heterocyclic compound represented by the general formula (III) or (IV).

5. The silver halide photographic emulsion as claimed in claim 1, wherein $Z_1$ and $Z_2$ represent the group of atoms necessary to form a thiazole nucleus.

6. The silver halide photographic emulsion as claimed in claim 1, wherein $Z_1$ and $Z_2$ represent the group of atoms necessary to form a selenazole nucleus.

7. The silver halide photographic emulsion as claimed in claim 1, wherein $Z_3$ represents the group of atoms necessary to form a thiazole nucleus.

8. The silver halide photographic emulsion as claimed in claim 7, wherein $Z_4$ represents the group of atoms necessary to form an imidazole nucleus.

9. The silver halide photographic emulsion as claimed in claim 7, wherein $Z_4$ represents the group of atoms necessary to form an oxazole nucleus.

10. The silver halide photographic emulsion of claim 1 wherein the at least one organic heterocyclic compound represented by said general formula (III) or (IV) is represented by general formula (III).

11. The silver halide photographic emulsion as claimed in claim 10, wherein said heterocyclic compound has formula:

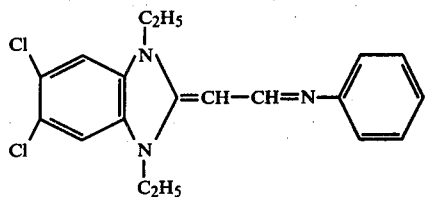

12. The silver halide photographic emulsion of claim 1 wherein said combination is of at least one dye of general formula (I) and at least one dye of general formula (II) with at least one organic heterocyclic compound of general formula (IV).

* * * * *